US007401638B2

(12) United States Patent
Lin et al.

(10) Patent No.: US 7,401,638 B2
(45) Date of Patent: Jul. 22, 2008

(54) HEAT-DISSIPATING DEVICE AND ITS MANUFACTURING PROCESS

(75) Inventors: Chen-Chang Lin, Taoyuan Hsien (TW); Wen-Shi Huang, Taoyuan Hsien (TW); Kuo-Cheng Lin, Kuei San (TW); Sheng-Hua Luo, Wujiang (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/516,639

(22) Filed: Sep. 7, 2006

(65) Prior Publication Data

US 2007/0000634 A1 Jan. 4, 2007

Related U.S. Application Data

(60) Continuation-in-part of application No. 10/755,322, filed on Jan. 13, 2004, now abandoned, which is a division of application No. 10/299,842, filed on Nov. 20, 2002, now Pat. No. 6,877,958, which is a continuation-in-part of application No. 10/172,976, filed on Jun. 18, 2002, now Pat. No. 6,779,992.

(30) Foreign Application Priority Data

Mar. 28, 2002 (TW) ..... 91203882 U
Jun. 10, 2002 (TW) ..... 91112474 A

(51) Int. Cl.
*B22D 29/00* (2006.01)
*B22D 33/04* (2006.01)

(52) U.S. Cl. ..... 164/131; 164/137; 164/339

(58) Field of Classification Search ..... 164/131, 164/132, 137, 339
See application file for complete search history.

(56) References Cited

U.S. PATENT DOCUMENTS

| | | | | |
|---|---|---|---|---|
| 3,595,301 | A * | 7/1971 | Bauer | 164/113 |
| 4,462,757 | A * | 7/1984 | Uemura | 416/244 R |
| 5,290,149 | A | 3/1994 | Vieth et al. | |
| 5,611,668 | A | 3/1997 | Yapp et al. | |
| 6,318,964 | B1 | 11/2001 | Yang | |
| 6,386,276 | B1 * | 5/2002 | Chen et al. | 165/121 |
| 6,463,991 | B1 | 10/2002 | Reelfs et al. | |
| 6,463,992 | B1 * | 10/2002 | Dowhan et al. | 164/46 |
| 6,511,300 | B2 | 1/2003 | Otsuka et al. | |
| 6,546,993 | B1 * | 4/2003 | Tilch | 164/132 |
| 6,572,336 | B2 | 6/2003 | Horng et al. | |
| 6,588,485 | B1 | 7/2003 | Decker | |
| 6,623,265 | B1 * | 9/2003 | Day | 425/438 |
| 6,779,992 | B2 | 8/2004 | Lei et al. | |
| 6,877,958 | B2 | 4/2005 | Lin et al. | |

* cited by examiner

FOREIGN PATENT DOCUMENTS

JP 63-171242 7/1988

*Primary Examiner*—Kevin P Kerns
(74) *Attorney, Agent, or Firm*—Birch, Stewart, Kolasch & Birch, LLP

(57) ABSTRACT

A heat-dissipating device and its manufacturing process are provided for significantly increasing the number and size of blades so as to enhance the heat-dissipating performance. The heat-dissipating device has a plurality of blades arranged around the hub of the heat-dissipating device and there is an overlapped region formed between every two adjacent blades. A single mold is used to manufacture such a heat-dissipating device so that not only can the manufacturing cost be reduced but it can significantly increase the number and size of blades so as to increase the heat-dissipating efficiency.

17 Claims, 8 Drawing Sheets

HEAT-DISSIPATING DEVICE AND ITS MANUFACTURING PROCESS

The present invention is a Continuation-in-Part Application of application No. 10/755,322, now abandoned, which is a Divisional of US. Pat. No. 6,877,958, which is a Continuation-in-Part of U.S. Pat. No. 6,779,992, the entire contents of which are hereby incorporated by reference and for which priority is claimed under 35 U.S.C. 120; and this application claims priority of Application Nos. 091112474 filed in Taiwan, R.O.C. on Jun. 10, 2002 and 091203882 filed in Taiwan, R.O.C. on Mar. 28, 2002, under 35 U.S.C. 119.

FIELD OF THE INVENTION

The present invention is related to a heat-dissipating device and its manufacturing process, and especially to an impeller having a plurality of blades and there is an overlapped region formed between every two adjacent blades for enhancing the heat-dissipating performance.

BACKGROUND OF THE INVENTION

Generally, in order to prevent the electronic device from being contaminated by particle or dust in the atmosphere, the electronic device is usually disposed in a closed housing. However, the electronic device will generate a lot of heat during the operating process. If the electronic device is continuously placed in a high-temperature state, it will easily cause damage to the electronic device and shorten its useful life. Thus, in order to prevent the malfunction of the electronic device, a heat-dissipating fan is usually used to dissipate the heat generated by the electronic device from inside to external environment.

Please refer to FIG. 1A which is a top view of a traditional fan. This fan includes a hub 11 and a plurality of blades 12 arranged around the hub but each blade does not overlap with the other. The mold used for manufacturing such a fan is composed of a male mold 13 and a female mold 14 and the separating line between the male mold and the female mold is indicated by an imaginary line 15 shown in FIG. 1B. When stripping the mold, the male mold 13 and the female mold 14 are separated from each other along the upward and downward directions, respectively, indicated by the arrows shown in FIG. 1B to complete the manufacturing process.

At the present time, a commonly used way for increasing the airflow discharged from the fan so as to enhance the heat-dissipating efficiency is to enlarge the size of blades of the fan or increase the number of blades. However, under the design limitation of mold used for manufacturing the fan, the size or number of blades of the fan can not be effectively increased to improve the heat-dissipating performance of the fan.

With the improvement of technology, one way is to allow two blades to be disposed closely as possible so as to slightly increase the discharged airflow. However, this way will let the mold have an acute notch as an edge on a knife, which may be vulnerable or easily damaged.

Therefore, it is desirable to provide a heat-dissipating device which can greatly enhance the heat-dissipating efficiency.

SUMMARY OF THE INVENTION

An object of the present invention is to provide a heat-dissipating fan and its manufacturing process for significantly increasing the number and size of blades so as to enhance the heat-dissipating performance. The heat-dissipating device has a plurality of blades arranged around the hub of the heat-dissipating device and there is an overlapped region formed between every two adjacent blades.

Another object of the present invention is to provide a heat-dissipating device having an overlapped region formed between every two adjacent blades thereof and manufactured by a single mold, which not only can reduce the manufacturing cost but can significantly increase the number and size of blades so as to increase the heat-dissipating efficiency.

Preferably, the hub and the plurality of blades are integrally formed by injection molding.

Preferably, each of the plurality of blades has one selected from a group essentially consisting of inclined plate, triangle, trapezoid, curved, arcuate and wing structures.

According to one aspect of the present invention, the process for manufacturing a heat-dissipating fan includes steps of: providing a mold including a first mold portion and a second mold portion, wherein the first mold portion is engaged with the second mold portion along a separating line between the first mold portion and the second mold portion, the separating line passing through a largest cross section in thickness of each blade of the heat-dissipating device along an axial direction; applying a desired material into a space defined in the mold for forming the heat-dissipating device therein so as to execute a forming step of the heat-dissipating device; and stripping the first mold portion and the second mold portion along an inclined direction of blades, thereby fabricating the heat-dissipating device.

Alternatively, another process for manufacturing an impeller including steps of: providing a mold including a first mold portion and a second mold portion, wherein the first mold portion is engaged with the second mold portion by spacing with a plurality of sliding blocks between the first mold portion and the second mold portion to form a space, the sliding blocks are radially arranged with respect to a center of the impeller; applying a desired material into the space defined in the mold for forming the impeller therein so as to execute a forming step of the impeller; and stripping the sliding blocks in turn along a plurality of predetermined directions corresponding to the blades, thereby fabricating the impeller.

Preferably, the desired material is one selected from a group consisting of an iron-containing material, metal and plastic. The first mold portion and the second mold portion are separated from each other through a toothed gearing mode during the stripping step.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4B shows that the female mold is turned over.

DETAILED DESCRIPTION OF THE PREFERRED EMBODIMENT

The present invention will now be described more detailedly with reference to the following embodiments. It is to be noted that the following descriptions of the preferred embodiments of this invention are presented herein for the purpose of illustration and description only. It is not intended to be exhaustive or to be limited to the precise form disclosed.

Please refer to FIGS. 2A~2E which are schematic diagrams showing a preferred embodiment of the process for manufacturing a heat-dissipating device 20 of the present invention. The heat-dissipating device 20 is composed of a cup-shaped body (or called "hub") 23 and a plurality of blades 24 arranged around the hub 23. There is an overlapped region formed between every two adjacent blades 24 that is, the region indicated by imaginary lines shown in FIG. 2E, to serve as an airflow guiding route. The manufacturing process is described in detail as follows.

Figure 1A:
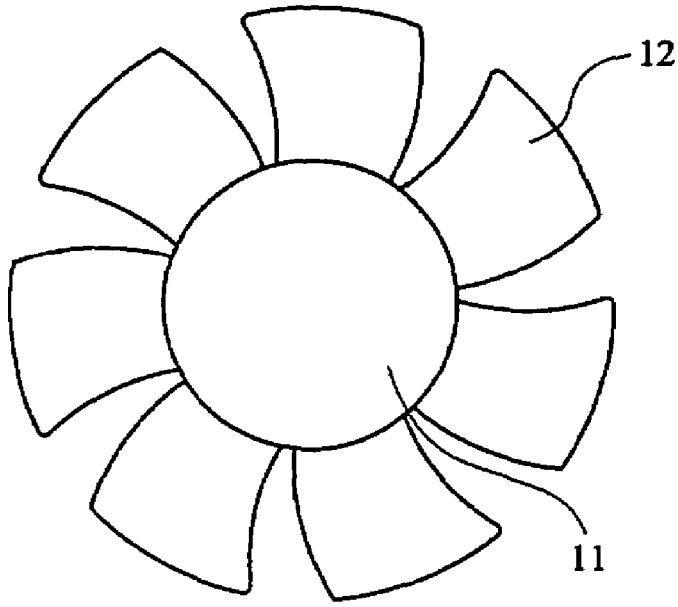
Fig. 1A ( Prior Art )
FIG. 1A is a top view of a conventional fan.
Figure 1B:
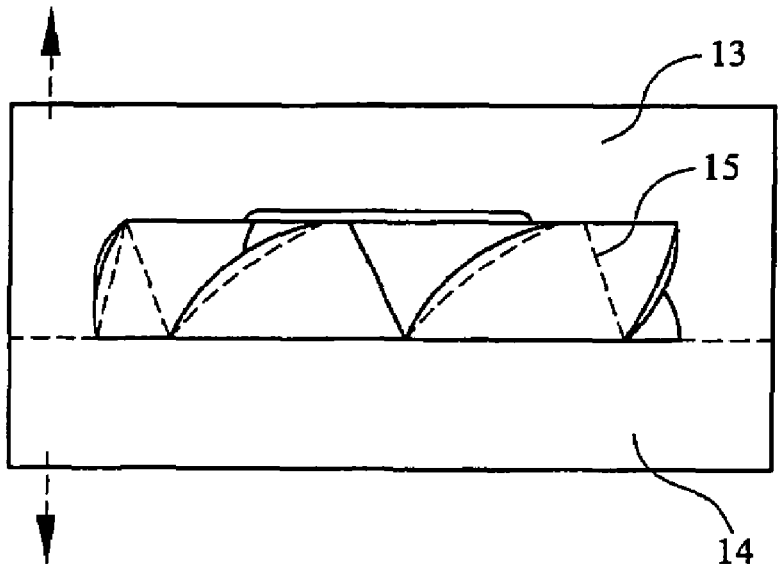
Fig. 1B ( Prior Art )
FIG. 1B is a schematic diagram showing how to separate the male and female molds used for manufacturing the conventional fan of FIG. 1A.
Figure 2A:
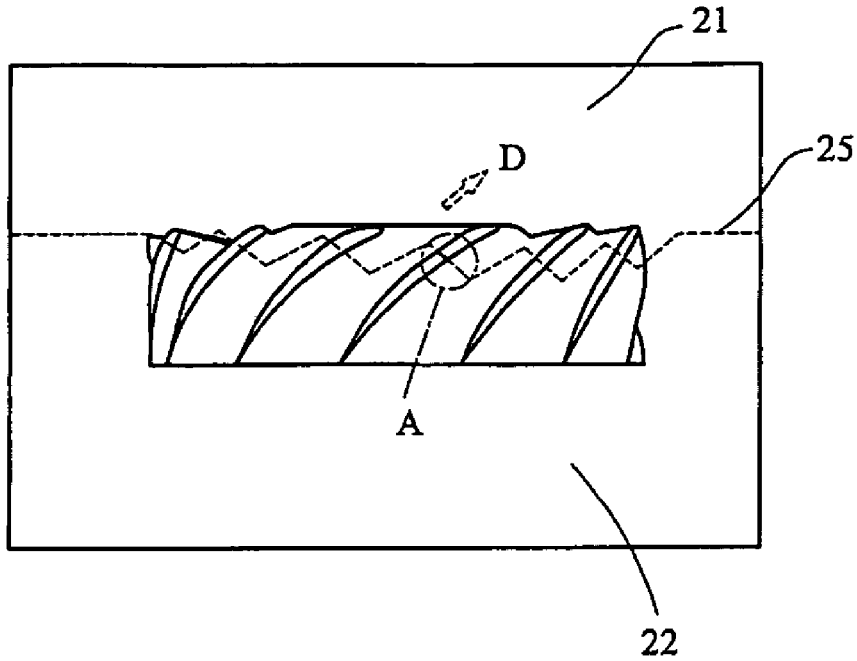
FIG. 2A is a schematic diagram showing how to separate the male and female molds used for manufacturing a preferred embodiment of the heat-dissipating device according to the present invention.

First of all, a mold is provided for manufacturing the heat-dissipating device 20. The mold includes a first mold portion 21 and a second mold portion 22 as shown in FIG. 2A. The separating line 25 between the first mold portion 21 and the second mold portion 22 is positioned corresponding to the largest cross section L (shown by FIG. 2B) in thickness of each blade 24 of the heat-dissipating device 20 along an axial direction to prevent the blades 24 of the fabricated product from being damaged when stripping the mold.

Then, a desired material is applied into a space defining in the mold for forming the heat-dissipating device therein so as to execute a forming step of the heat-dissipating device, for example, a heating or pressing step. Generally, the desired material can be an iron-containing material, metal, plastic, etc.

Figure 2B:
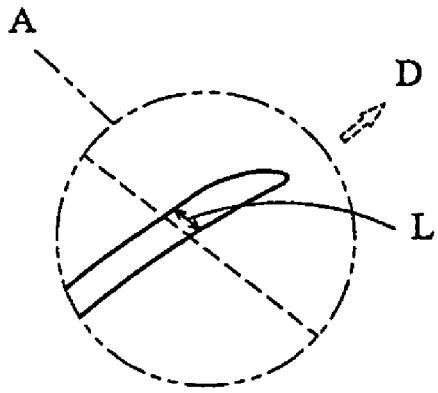
FIG. 2B is a partially amplified diagram of the circular part A shown in FIG. 2A.
Figure 2C:
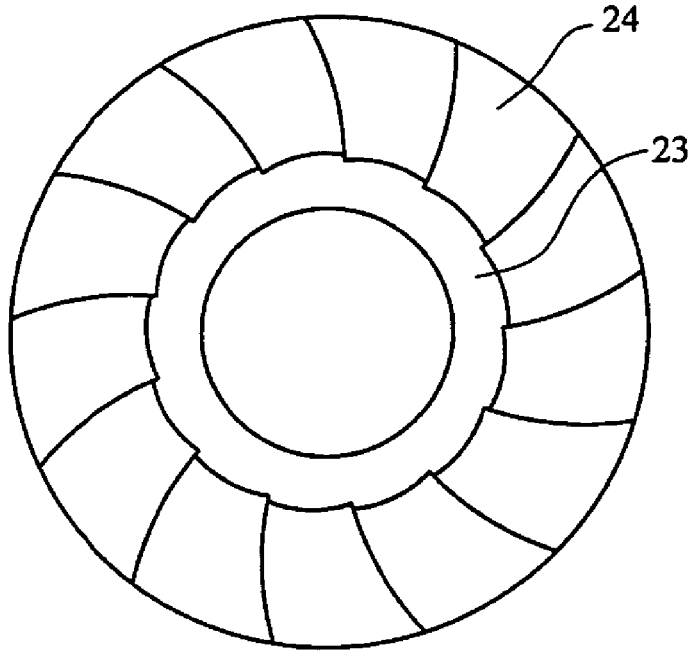
FIG. 2C is a top view of the heat-dissipating device manufactured by the method shown in FIG. 2A.
Figure 2D:
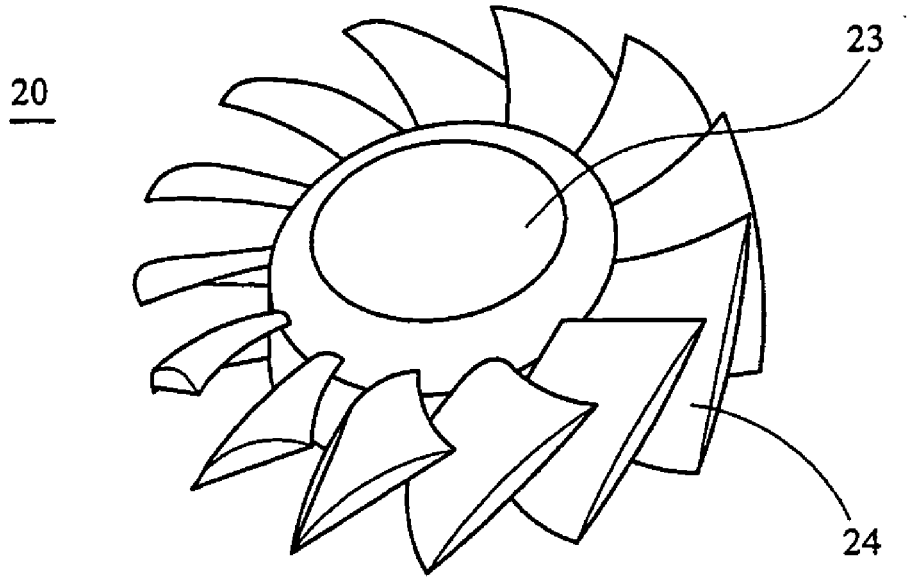
FIG. 2D is a perspective view of the heat-dissipating device of FIG. 2C.
Figure 2E:
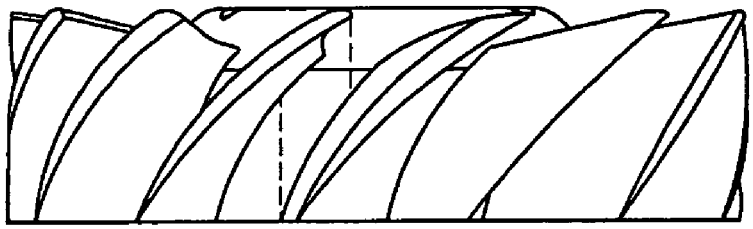
FIG. 2E is a side view of the heat-dissipating device of FIG. 2D.

During the stripping step, the first mold portion and the second mold portion are separated from each other along an inclined direction of blades of the heat-dissipating device through a toothed gearing mode, as the direction D shown in FIG. 2A or 2B. From the top view, the fabricated heat-dissipating device has an appearance as shown in FIG. 2C due to the formation of the overlapped region.

Figure 3A:
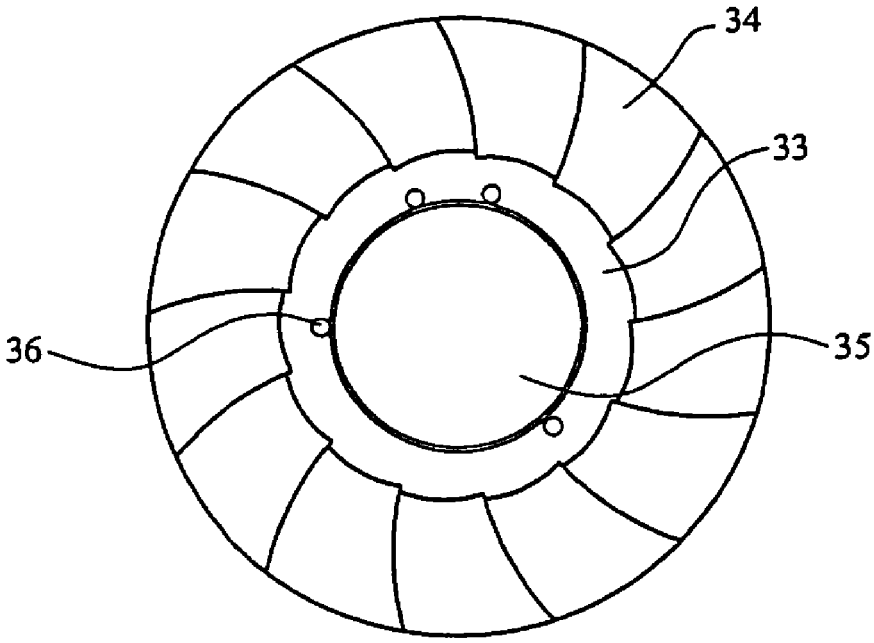
FIG. 3A is a top view of another preferred embodiment of the heat-dissipating device of the present invention.
Figure 3B:
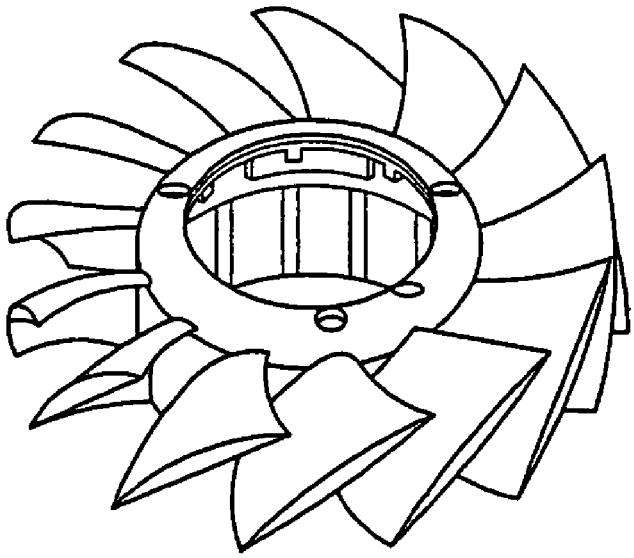
FIG. 3B is a perspective view of the heat-dissipating device of FIG. 3A.

In addition, referring to FIGS. 3A and 3B which show another preferred embodiment of the heat-dissipating device of the present invention. Its manufacturing process is similar to that of the above-mentioned embodiment. The heat-dissipation device is composed of a hub 33 and a plurality of blades 34 arranged around the hub 33. The difference is that the hub 33 of the fabricated heat-dissipating device has a central opening 35 and a plurality of heat-dissipating holes 36 are formed on the periphery of the central opening 35 to further dissipate the heat generated from the required device mounted under the hub such as a motor when the heat-dissipating device is driven by motor to rotate.

In above-described embodiments, each blade has the appearance like an inclined plate, triangle, trapezoid, curved, arcuate or wing structure.

Consequently, in the present invention, the plurality of blades are arranged around the hub of the heat-dissipating device and there is an overlapped region formed between every two adjacent blades. Moreover, the heat-dissipating device is manufactured by a single mold, which not only can reduce the manufacturing cost but can significantly increase the number and size of blades so as to increase the heat-dissipating efficiency and performance.

Alternatively, please refer to FIGS. 4A~4E which are schematic diagrams showing another process for manufacturing an impeller according to the preferred embodiment of the present invention. The impeller (or called "the heat-dissipating device") 40, is composed of a cup-shaped body (or called "hub") 45 and a plurality of blades 44 arranged around the hub 45. It is understood that the impeller 40 has similar structure like the heat-dissipating device, i.e. the impeller 20 in FIG. 2D, and the difference is the number of the blades. There is an overlapped region formed between every two adjacent blades, that is, the region indicated by imaginary lines shown in FIG. 2E, to serve as an airflow guiding route. Another manufacturing process of the impeller 40 is described in detail as follows.

Figure 4A:
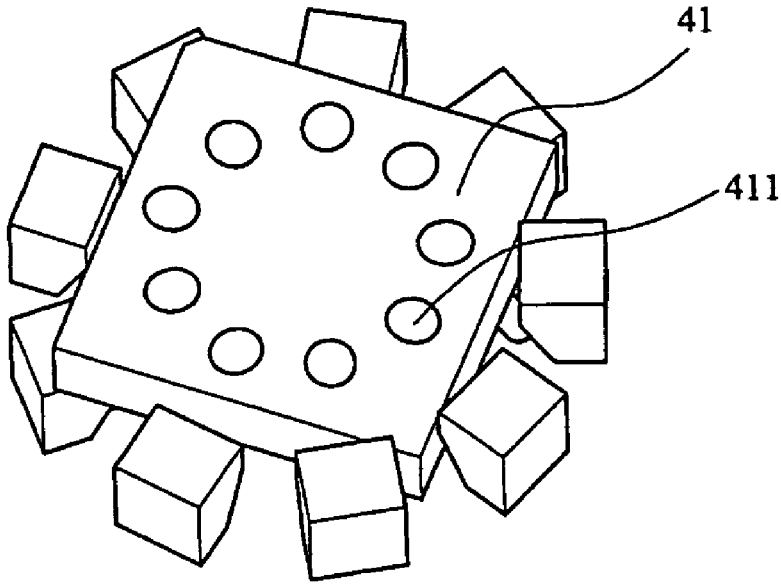
FIG. 4A is a schematic diagram showing another female mold used for manufacturing a preferred embodiment of the heat-dissipating device according to the present invention.
Figure 4B:
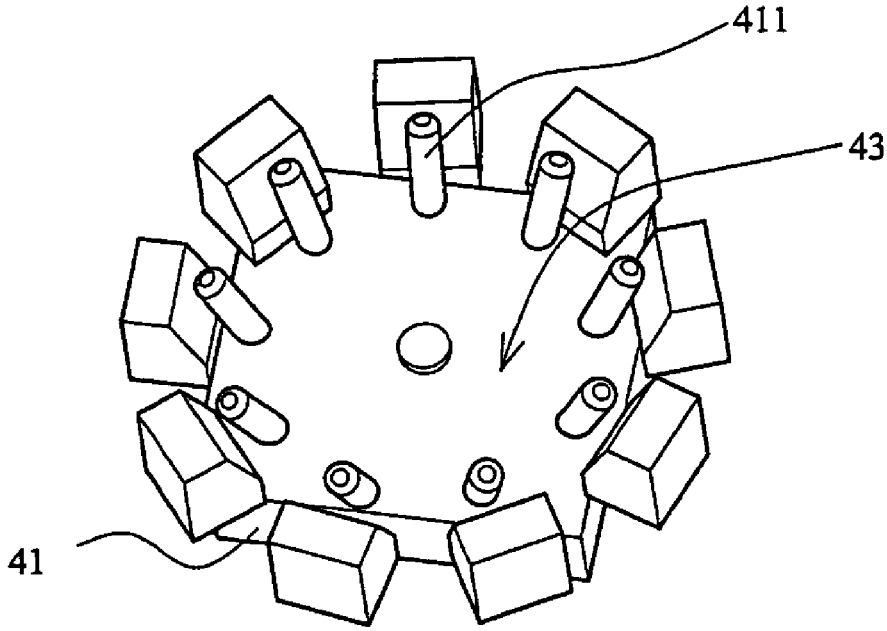
FIG. 4B is another schematic diagram of the female mold in FIG. 4A.
Figure 4C:
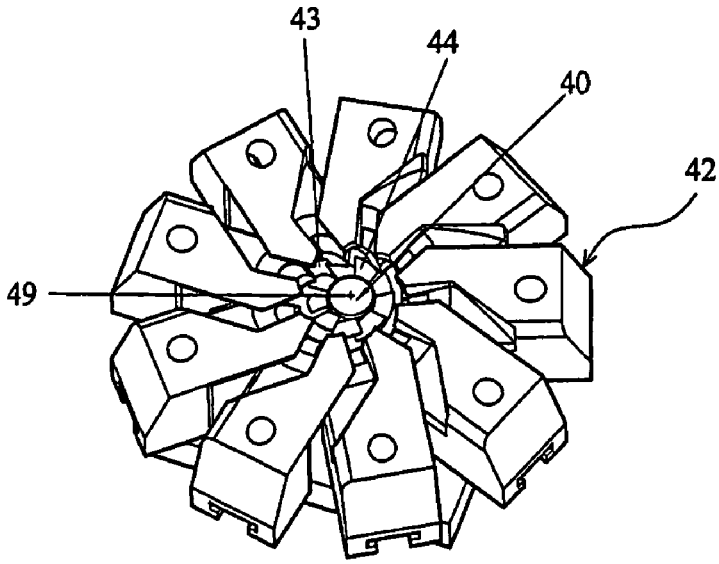
FIG. 4C is a schematic diagram showing the impeller and another male mold used for manufacturing a preferred embodiment of the heat-dissipating device according to the present invention.
Figure 4D:
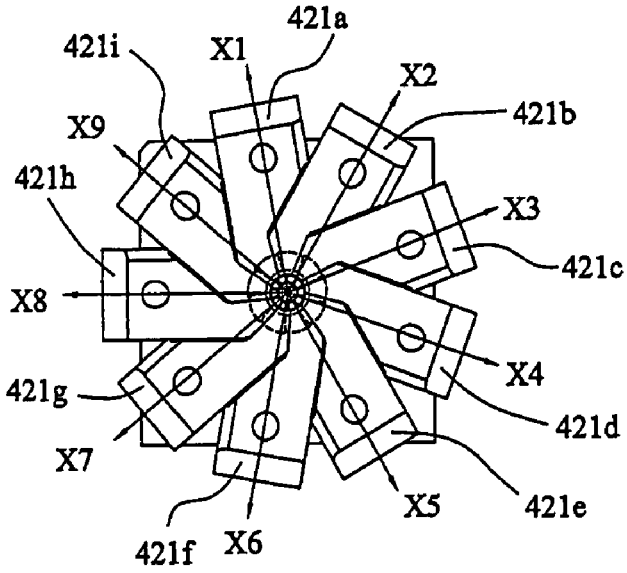
FIG. 4D is a top view of the male mold and the impeller in FIG. 4C.
Figure 4E:
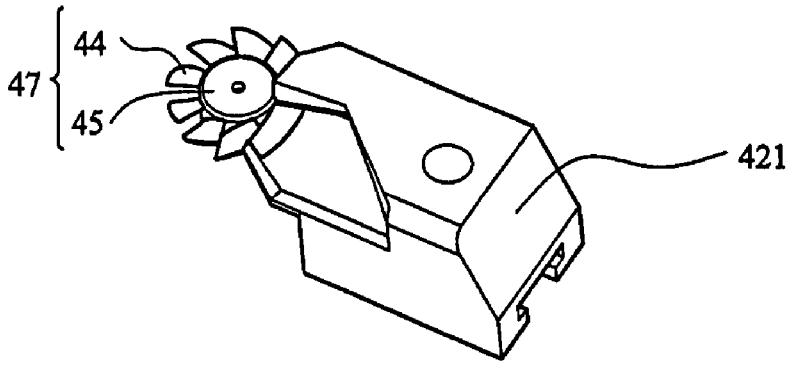
FIG. 4E is a schematic diagram showing how to strip the sliding block according to a preferred embodiment of the process for manufacturing an impeller of the present invention.

First of all, a mold is provided for manufacturing the impeller 40. The mold includes a first mold portion 41 (as shown in FIG. 4A) and a second mold portion 42 (as shown in FIG. 4C) serving as the female mold and the male mold, respectively. Referring to FIGS. 4A to 4E, the first mold portion 41 is engaged with the second mold portion 42 by spacing with a plurality of sliding blocks 421 between the first mold portion 41 and the second mold portion 42 to form a space 43. The sliding blocks 421 are radially arranged with respect to a center 49 of the impeller 40. There are a plurality of the guiding posts 411 disposed with the first mold portion 41, and each of the sliding blocks 421 are penetrated through by a guiding post 411 so as to position the sliding blocks 421 between the first mold portion 41 and the second mold portion 42.

Then, a desired material is applied into the space 43 defining in the mold for forming the impeller 40 therein so as to execute a forming step, for example, a heating and pressing step, or an injection molding step. Generally, the desired material can be an iron-containing material, metal, plastic, etc.

First of all, a mold is provided for manufacturing the impeller 40. The mold includes a first mold portion 41 (as shown in FIG. 4A) and a second mold portion 42 (as shown in FIG. 4C) serving as the female mold and the male mold, respectively. Referring to FIGS. 4A to 4E, the first mold portion 41 is engaged with the second mold portion 42 by spacing with a plurality of sliding blocks 421 between the first mold portion 41 and the second mold portion 42 to form a space 43. The sliding blocks 421 are radially arranged with respect to a center 49 of the impeller 40. There are a plurality of the guiding posts 411 disposed with the first mold portion 41, and each of the sliding blocks 421 are penetrated through by a guiding post 411 so as to position the sliding blocks 421 between the first mold portion 41 and the second mold portion 42.

Consequently, in the present invention, the plurality of blades are arranged around the hub of the impeller and there is an overlapped region formed between every two adjacent blades. Moreover, the heat-dissipating device is manufactured by a single mold, which not only can reduce the manufacturing cost but can significantly increase the number and size of blades so as to increase the heat-dissipating efficiency and performance.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A process for manufacturing a heat-dissipating device having a body and a plurality of blades with varied thickness and arranged around the body, wherein the body and the blades are integrally formed as a single unit, and there is an overlapped region formed between every two adjacent blades, the process comprising the steps of:

providing a mold including a first mold portion and a second mold portion, wherein the first mold portion is engaged with the second mold portion along a separating line between the first mold portion and the second mold portion, the separating line passing through a largest cross section in thickness of each blade of the heat-dissipating device;

applying a desired material into a space defined in the mold for forming the heat-dissipating device therein so as to execute a forming step of the heat-dissipating device; and stripping the first mold portion and the second mold portion along an inclined direction of blades, thereby fabricating the heat-dissipating device.

2. The process according to claim 1, wherein the desired material is one selected from a group consisting of an iron-containing material, metal and plastic.

3. The process according to claim 1, wherein the first mold portion and the second mold portion are separated from each other by gear transmission during the stripping step.

4. The process according to claim 1, wherein the body is formed as a cup-shaped hub.

5. The process according to claim 4, wherein the body is provided with a central opening.

6. The process according to claim 5 wherein the body is further provided with a plurality of heat-dissipating holes formed around the central opening.

7. The process according to claim 1 wherein the body and the plurality of blades are integrally formed by injection molding.

8. The process according to claim 1, wherein each of the blades is shaped as a structure selected from an inclined plate, a triangle, a trapezoid, a curved, an arcuate and a wing structure.

9. A process for manufacturing an impeller having a body and a plurality of blades with varied thickness and arranged around the body, wherein the body and the blades are integrally formed as a single unit, and there is an overlapped region formed between every two adjacent blades, the process comprising the steps of:

providing a mold including a first mold portion and a second mold portion, wherein the first mold portion is engaged with the second mold portion by spacing with a plurality of sliding blocks between the first mold portion and the second mold portion to form a space, the sliding blocks are radially arranged with respect to a center of the impeller;

applying a desired material into the space defined in the mold for forming the impeller therein so as to execute a forming step of the impeller; and stripping the sliding blocks along a plurality of predetermined directions corresponding to the blades, thereby fabricating the impeller.

10. The process according to claim 9, wherein each of the sliding blocks are penetrated through by a guiding post so as to position the sliding blocks between the first mold portion and the second mold portion.

11. The process according to claim 9, wherein the desired material is one selected from a group consisting of an iron-containing material, metal and plastic.

12. The process according to claim 9, wherein each blade is formed by stripping one sliding block during the stripping step.

13. The process according to claim 9, wherein the body is formed as a cup-shaped hub.

14. The process according to claim 13, wherein the body is provided with a central opening.

15. The process according to claim 14, wherein the body is further provided with a plurality of heat-dissipating holes formed around the central opening.

16. The process according to claim 9, wherein the body and the plurality of blades are integrally formed by injection molding.

17. The process according to claim 9, wherein each of the blades is shaped as a structure selected from an inclined plate, a triangle, a trapezoid, a curved, an arcuate and a wing structure.

* * * * *